US006919872B2

(12) United States Patent
Park et al.

(10) Patent No.: US 6,919,872 B2
(45) Date of Patent: Jul. 19, 2005

(54) METHOD AND APPARATUS FOR DRIVING STN LCD

(75) Inventors: Tae-Kwang Park, Seoul (KR); Keunmyung Lee, Palo Alto, CA (US)

(73) Assignee: Leadis Technology, Inc., Sunnyvale, CA (US)

( * ) Notice: Subject to any disclaimer, the term of this patent is extended or adjusted under 35 U.S.C. 154(b) by 297 days.

(21) Appl. No.: 10/082,942

(22) Filed: Feb. 25, 2002

(65) Prior Publication Data

US 2002/0158832 A1 Oct. 31, 2002

Related U.S. Application Data

(60) Provisional application No. 60/271,452, filed on Feb. 27, 2001.

(51) Int. Cl.[7] ..... G09G 3/36

(52) U.S. Cl. ..... 345/98; 345/90; 345/103

(58) Field of Search ..... 345/87–90, 98, 345/100, 103, 530, 543, 544, 554, 562

(56) References Cited

U.S. PATENT DOCUMENTS 5,420,604 A 5/1995 Scheffer et al.
5,684,502 A 11/1997 Fukui et al.
5,689,280 A 11/1997 Asari et al.
5,754,157 A 5/1998 Kuwata et al.
5,764,212 A 6/1998 Nishitani et al.
5,786,799 A 7/1998 Matsui et al.
5,818,409 A * 10/1998 Furuhashi et al. ..... 345/94
5,852,429 A * 12/1998 Scheffer et al. ..... 345/100
5,877,738 A * 3/1999 Ito et al. ..... 345/94
5,900,856 A * 5/1999 Iino et al. ..... 345/100
6,252,572 B1 * 6/2001 Kurumisawa et al. ..... 345/98
6,483,497 B1 * 11/2002 Iino et al. ..... 345/100
6,611,246 B1 * 8/2003 Ito et al. ..... 345/94

FOREIGN PATENT DOCUMENTS

JP 2000-172236 A 6/2000
JP 2000-258751 A 9/2000

* cited by examiner

*Primary Examiner*—Henry N. Tran
(74) *Attorney, Agent, or Firm*—Fenwick & West LLP

(57) ABSTRACT

A driver for driving an STN LCD is disclosed. A preferred embodiment comprises a 3-line output display data for storing display data, an XOR block for finding mismatches between each 3-line output set of the stored display and orthogonal function signals, a decoder block for calculating mismatch numbers, a level shifter block for shifting the data level of the mismatch numbers to another level, and a voltage selector block for selecting a voltage level from 2 levels of voltage. Because data latches and output latches are not necessary, the driver of the present invention achieves significant reduction in the circuit components and chip size without compromising the display quality.

14 Claims, 9 Drawing Sheets

(Present Invention)

FIG. 3 (Present Invention)

241 242

I (0,0) I (1,0) I (2,0) ---------- I (0,127) I (1,127) I (2,127)

| | | | | | | | |
|---|---|---|---|---|---|---|---|
| 0 | I (0,0) | I (1,0) | I (2,0) | ------ | I (0,127) | I (1,127) | I (2,127) |
| 1 | I (3,0) | I (4,0) | I (5,0) | ------ | I (3,127) | I (4,127) | I (5,127) |
| 2 | I (6,0) | I (7,0) | I (8,0) | ------ | I (6,127) | I (7,127) | I (8,127) |
| ⋮ | ⋮ | ⋮ | ⋮ | ------ | ⋮ | ⋮ | ⋮ |
| 53 | I (159,0) | I (160,0) | I (161,0) | ------ | I (159,125) | I (160,127) | I (161,127) |
| 54 | I (162,0) | I (163,0) | I (164,0) | ------ | I (162,125) | I (163,127) | I (164,127) |
| 55 | I (165,0) | I (166,0) | I (167,0) | ------ | I (165,127) | I (166,127) | I (167,127) |
| i / j | 0 | 1 | 2 | ------ | 125 | 126 | 127 |

FIG. 5

| i \ j | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| 1 | 1 | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 | 0 | 0 | 0 |
| 2 | · | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 |
| 3 | 1 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 |
| v1 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 |
| 4 | 0 | · | 0 | 0 | 0 | 0 | 0 | 0 | 0 | · | 0 | 0 | 0 | 0 | 0 | 0 | 0 | · | 0 | 0 | 0 | 0 | 0 | 0 | 0 | 1 | 0 | 0 | 0 | 0 | 0 | 0 |
| 5 | 0 | · | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | · | 0 | 0 | 0 | 0 | 0 | 0 |
| 6 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 |
| v2 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 | 0 | 0 |
| 7 | 0 | 0 | · | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | · | 0 | 0 | 0 | 0 | 0 |
| | 0 | 0 | 1 | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 | 0 |
| 9 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 |
| v3 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 |
| 10 | 0 | 0 | 0 | · | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 |
| 11 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 |
| 12 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 |
| v4 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 |
| 13 | 0 | 0 | 0 | 0 | 1 | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 |
| 14 | 0 | 0 | 0 | 0 | · | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | · | 0 | 0 | 0 |
| 15 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 |
| v5 | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 |
| 16 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 | 0 | 0 | 0 | 1 | 0 | 0 |
| 17 | 0 | 0 | 0 | 0 | 0 | · | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | · | 0 | 0 |
| 18 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 0 |
| v6 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 |
| 19 | 0 | 0 | 0 | 0 | 0 | 0 | · | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | · | 0 |
| 20 | 0 | 0 | 0 | 0 | 0 | 0 | 1 | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 |
| 21 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 |
| v7 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 |
| 22 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | · |
| 23 | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · | 0 | 0 | 0 | 0 | 0 | 0 | 0 | · |
| 24 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · | 0 | 0 | 0 | 0 | 0 | 0 | 0 | 1 |
| v8 | 0 | 0 | 0 | 0 | 0 | 0 | 0 | · | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | · |

FIG. 7

METHOD AND APPARATUS FOR DRIVING STN LCD

RELATED APPLICATION

This application claims the benefit of co-pending U.S. Provisional Application Ser. No. 60/271452, filed Feb. 27, 2001, entitled "Method and Apparatus for Driving STN LCD."

BACKGROUND OF THE INVENTION

1. Technical Field

This invention in general relates to semiconductor circuits. More specifically, this invention relates to circuits for driving STN liquid crystal displays.

2. Description of the Related Art

FIG. 1 shows a structure of conventional supertwisted nematic ("STN") liquid crystal display ("LCD") module, which comprises an LCD panel 101 consisting of row electrodes 102 and column electrodes 103, a row driver 104 for applying row driving voltages to the row electrodes 102, and a column driver 105 for applying column driving voltages to the column electrodes 103. Pixels are formed at every crosssection of the row and column electrodes, such as at 106. Each pixel changes to black, white, or a different shade of gray or color depending on the voltages applied by the corresponding row and column electrodes across the liquid crystal to change the light transmittance.

In order to display a frame of data, voltages must be applied to all the individual electrodes so that all the pixels are addressed. In conventional sequential driving methods, each row electrode is selected sequentially (also called "scanning electrode") and the pixel data values corresponding to the selected scanning electrode are applied to the corresponding column electrode. Each frame needs to be displayed repeatedly to maintain a certain RMS value of each pixel so that the frames can be recognized by human eyes without any flickering.

In the cases where the display data needs to be changed very fast such as in displaying moving pictures, the conventional sequential driving methods suffers so-called a "frame response phenomenon." In order to drive a high-speed or large-panel liquid crystal, driving pulses of high-amplitude and short pulse width are required, which causes uneven brightness of the LCD panel.

Multi-line addressing (MLA) methods have been suggested for driving flat panel devices as alternatives to sequential driving methods. According to the MLA methods, multiple row electrodes are selected simultaneously to enable multiple selection of row electrodes within a frame cycle to increase the effective duty cycle of the row voltage application. Typically, orthogonal signals are applied to a set of row electrodes so that the individual electrodes can maintain the same effective RMS values within a frame.

When orthogonal row signals are simultaneously applied to a set of row electrodes, new column signals must be determined to maintain the correct pixel data. In other words the voltage levels to column electrodes should be recalculated, taking into account of simultaneous driving of multiple row electrodes.

FIG. 2 shows a block diagram of a conventional 4-line MLA column driver. A display data RAM 121 stores data for display and outputs some of the display data for latch by a display data latch 122. In order to facilitate recalculation of the column signals, orthogonal row signals Fi(t) applied to a set of row electrodes are compared with the display data of the same set of row electrodes at an XOR block 123 column by column to find mismatches between the orthogonal signals Fi(t) and display data for each column. A decoder block 124 calculates mismatch numbers based on the result of mismatches from the XOR block 123. After the mismatch numbers are latched at an output latch block 125, the data levels of the mismatch numbers are shifted at a level shifter block 126, and a voltage selector 127 selects a voltage level among 5 different voltages levels based on the level-shifted mismatch numbers.

Because the conventional MLA driver uses data and output latches, it requires a large chip area in its implementation, which adversely affect the performance of the driver. Therefore, there is a need for a new driver that requires less number of circuit components and chip area to improve the performance.

SUMMARY OF THE INVENTION

It is an object of the present invention to provide an efficient LCD driver optimized in the chip area to improve the performance.

The foregoing and other objects are accomplished by a virtual-line MLA using multiple-output display data RAM. A preferred embodiment comprises a 3-line output display data for storing display data, an XOR block for finding mismatches between each 3-line output set of the stored display and orthogonal function signals, a decoder block for calculating mismatch numbers, a level shifter block for shifting the data level of the mismatch numbers to another level, and a voltage selector block for selecting a voltage level from 2 levels of voltage. Because data latches and output latches are not necessary, the driver of the present invention achieves a significant reduction in the circuit components and chip size without compromising the display quality.

BRIEF DESCRIPTION OF THE DRAWINGS

FIG. 5 is an illustration of an alternative embodiment of a display data RAM. According to the present invention

FIG. 7 is an illustration of an example of orthogonal functions used for the virtual-line MLA of the present invention.

DETAILED DESCRIPTION OF THE INVENTION

Figure 1:
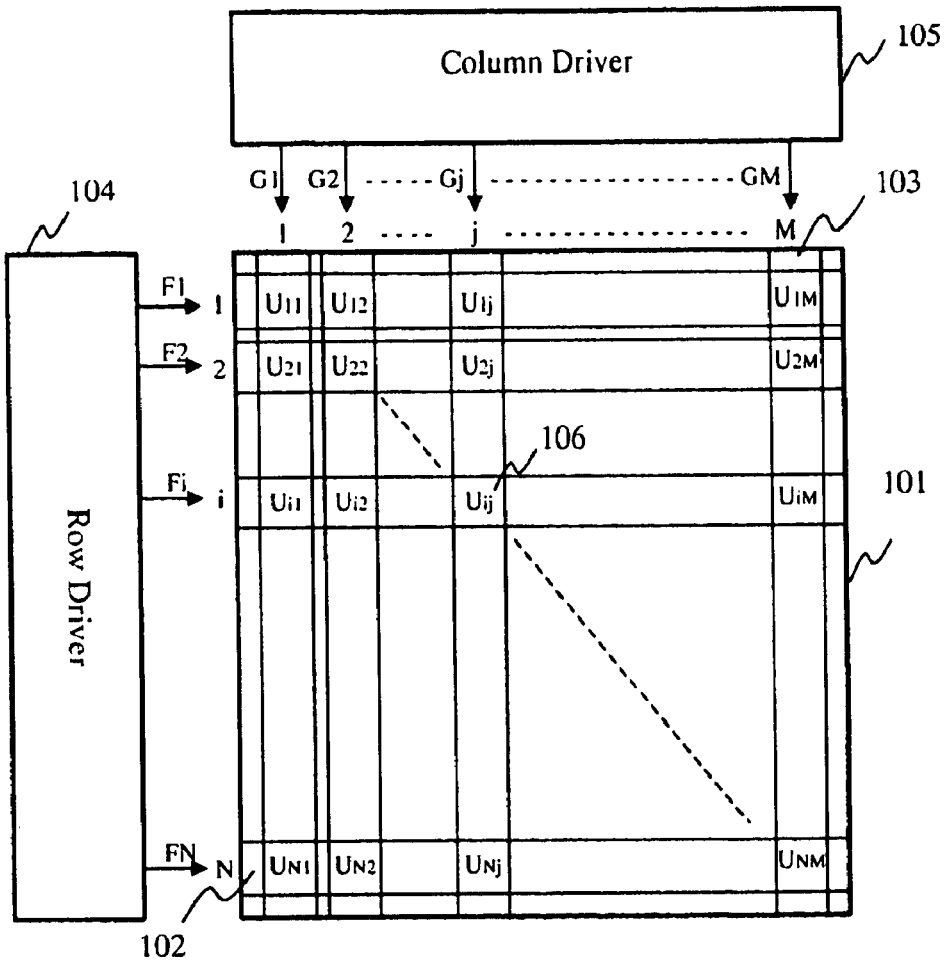
FIG. 1 (Related Art)
FIG. 1 is a block diagram of a conventional LCD.
Figure 2:
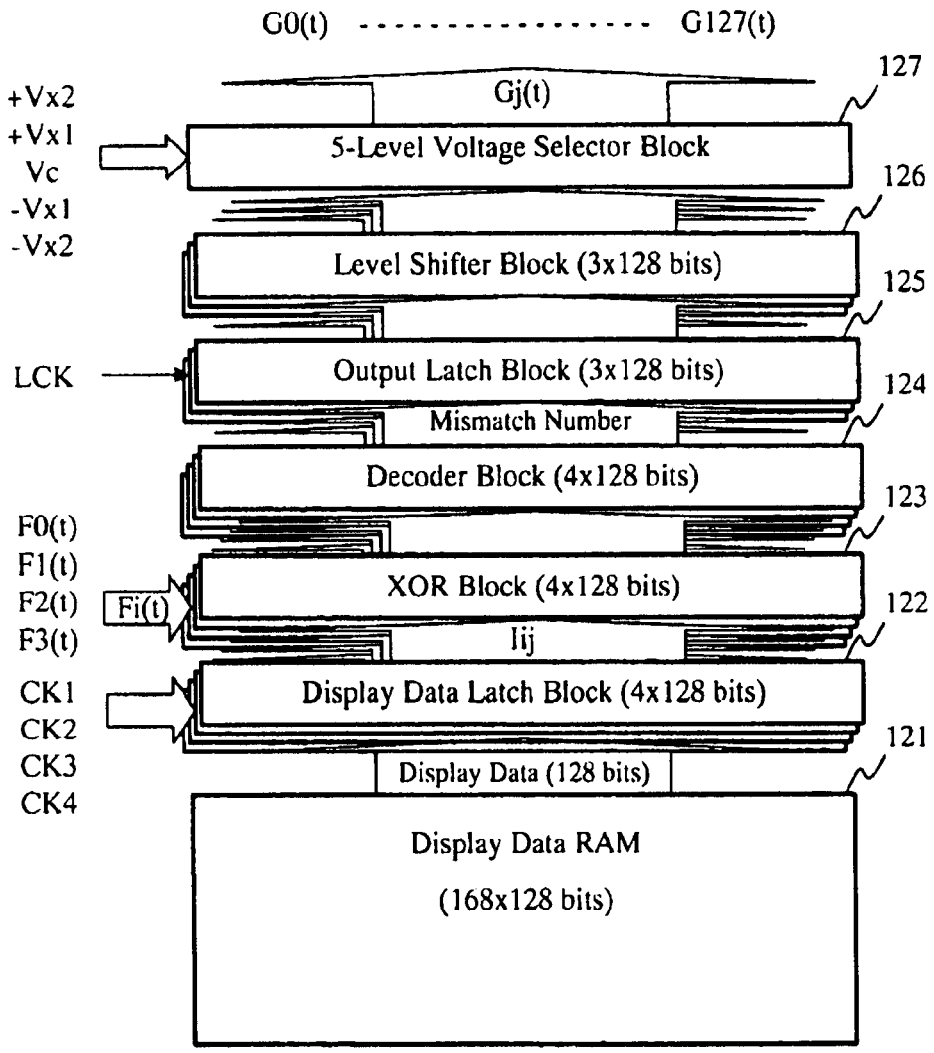
FIG.2 (Related Art)
FIG. 2 is a block diagram of a conventional MLA driver.
Figure 3:
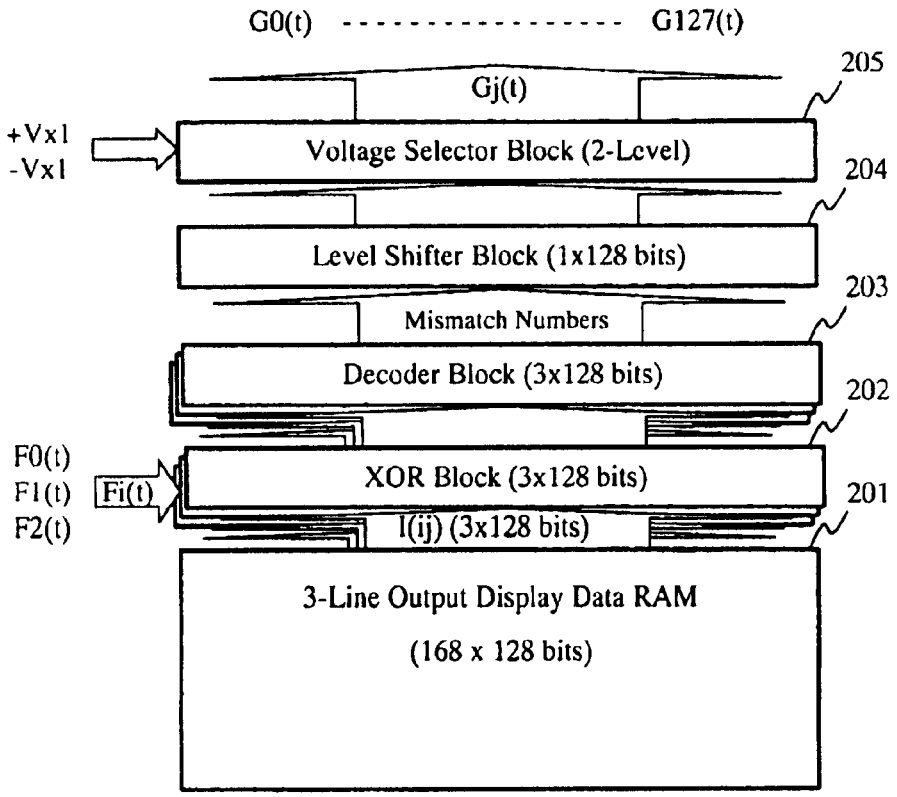
FIG. 3 is a block diagram of a new MLA driver of the present invention.

FIG. 3 shows a block diagram of a preferred embodiment of an MLA driver of the present invention. The preferred embodiment includes a 3-line output display data RAM 201 that is capable of simultaneously/concurrently outputting 3 lines of data. Because 3-line data items are outputted simultaneously, display data latches are no longer needed for calculating mismatch numbers with orthogonal functions.

Moreover, since the output data items from the 3-line output display data RAM are synchronized to the system clock, the output latches are also unnecessary. In the preferred embodiment, the display data RAM 201 stores 168 rows and 128 columns of bits that represents pixel data for a 168×128 display.

The present invention employs a virtual-line MLA, where a "virtual" row signal is additionally provided after every three "real" row signals. The virtual row signal is not used in accessing stored data. Instead, the virtual row signal is used only for the purpose of simplifying calculation of mismatch numbers and thereby facilitating calculation of column signals. Three real row signals and one virtual row signal constitute a set of 4-line orthogonal signals that combine with display data to produce column signals that would produce the correct display when multiple row electrodes are simultaneously driven.

The following table compares the method of calculating mismatch numbers using the orthogonal function of the present invention with the convention method. By employing 3 real lines and a virtual line, only 2 kinds of mismatch numbers may be used, namely, "1" and "3", compared to the conventional 4-line MLA using 5 kinds of mismatch numbers of "0", "1","2", "3", "4".

| Mismatch Number Conventional art | Mismatch Number Present Invention | Comment |
|---|---|---|
| 0 (−Vx2) | 1 (−Vx1) | Add one mismatch |
| 1 (−Vx1) | 1 (−Vx1) | Not converted |
| 2 (Vc) | 3 (+Vx1) | Add one mismatch |
| 3 (+Vx1) | 3 (+Vx1) | Not converted |
| 4 (+Vx2) | — | Not happen |

Figure 4:
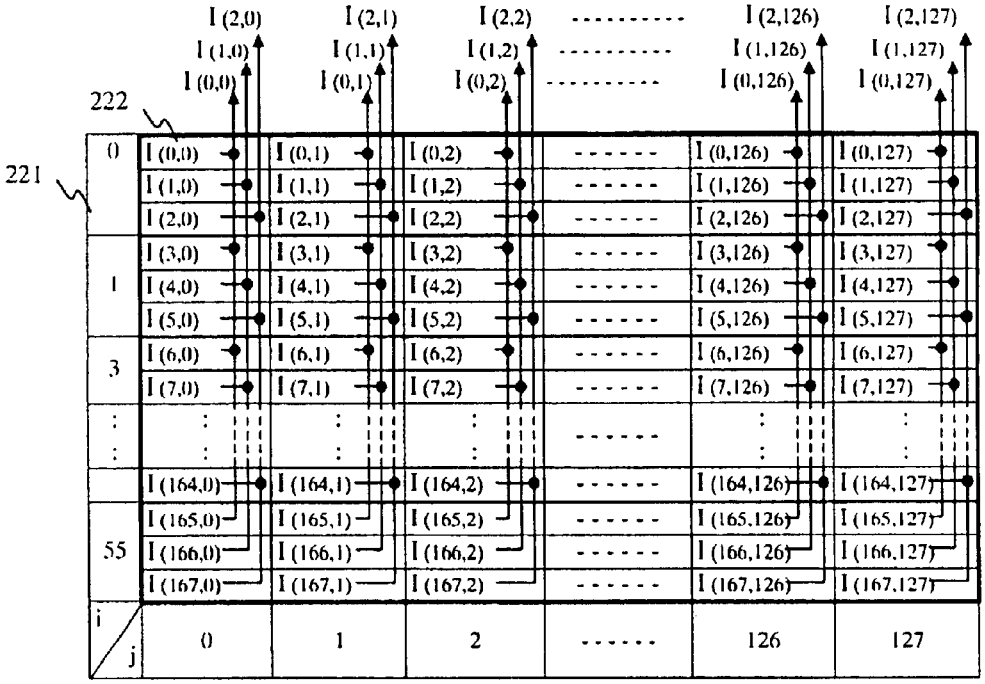
FIG. 4 is an illustration of an embodiment of a display data RAM according to the present invention.

FIG. 4 schematically shows an embodiment of the 3-line output display data RAM. As the display is partitioned into scan blocks of 3 scan lines, the display data RAM is also partitioned into blocks, such as block 0, 221, each block consisting of 3 rows. Scanning is performed on blocks of rows rather than individual rows.

For column 0, the first line outputs at each scan I (0,0), I (3,0), I (6,0), . . . I(3×(block number), 0). The second line outputs at each scan I(1,0), I(4,0), I(5,0), . . . I(3×(block number)+1, 0) The third line outputs at each scan I(2,0), I(5,0), I(6,0), . . . , I(3×(block number)+2, 0). At the first scan, for example, the three lines output I(0,0), I(1,0), and I(2,0) simultaneously, which are combined with orthogonal function signals.

Similarly, for column 1, the first line outputs at each scan: I(0,1), I(3,1), I(6,1), . . . I(3×(block number) 1). The second line outputs at each scan: I(1,1), I(4,1), I(5,1), . . . I(3×(block number)+1, 1) The third line outputs at each scan: I(2, 1), I(5,1), I(6,1), . . . , I(3×(block number)+2, 1). At the first scan, for example, the three lines output I(0,1), I(1,1), and I(2,1) simultaneously, which are combined with orthogonal function signals.

FIG. 5 shows an alternative embodiment of a display data RAM of the present invention. The display is partitioned into scan blocks of 3 scan lines. The display data RAM is also partitioned, but the 3 display data items in adjacent rows along the same column are arranged within the display data RAM in a horizontal fashion to achieve a more efficient layout. For example, I(0,0), I(1,0), and I(2,0) are arranged in horizontally rather than vertically.

Figure 6:
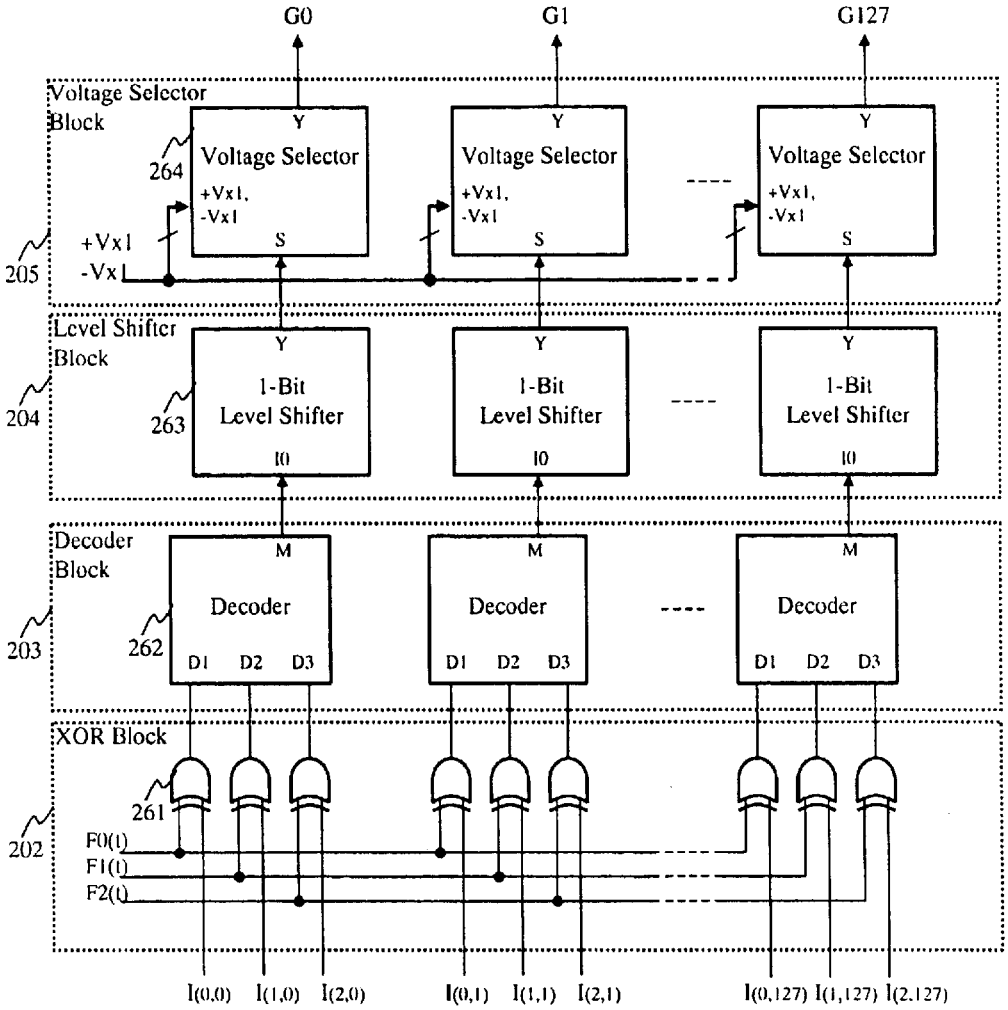
FIG. 6 is a schematic block diagram of the MLA driver.

FIG. 6 schematically illustrates the blocks of FIG. 3 in more detail except the display data RAM. The XOR block 202 consists of triples of XOR gates, such as 261. The three rows of display data along the same column currently output by the display RAM 201, such as I(0,0), I(1,0), I(2,0), are compared with orthogonal row signals $F_i(t)$ at the XOR block 202 to compute mismatch numbers. The decoder block 203 consists of 128 individual decoders, such as 262, each having 3 inputs for generating the number of mismatches for each column. The mismatch numbers are used by the level shifter block 204 having 128 1-bit level shifters, such as 263, and the voltage selector 205 having 128 individual voltage selectors, such as 264, each selecting either +Vx1 or −Vx1.

Each individual voltage selector 264 selects +Vx1 for a mismatch number of "1" and −Vx1 for a mismatch number of "3". Since a voltage level is selected from 2 voltage levels, the construction is simpler than that of the conventional method of selecting one voltage level from 5 voltage levels of −Vx2 , −Vx1 , Vc, +Vx1 , and +Vx2.

As mentioned above, there is no need for display data latches and output data latches that were essential in the implementation of the conventional MLA methods. With the use of the multi-line output type RAM of the present invention, the circuit components of a column driver are reduced, resulting a smaller chip size.

FIG. 7 shows an example of orthogonal functions of signals applied to scan lines. The scan lines are divided into blocks where each block is made of block of 3 lines and 1 virtual line rather than a block of 4 lines in the convention MLA. There are 32 scan lines in total, which are 24 lines actually used and 8 virtual lines.

Figure 8:
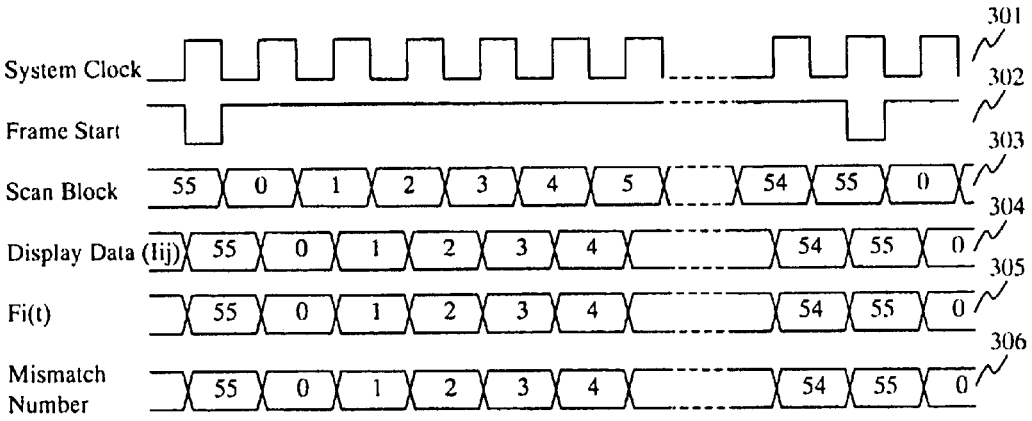
FIG. 8 is a timing diagram for the MLA driver according to the present invention.

FIG. 8 shows a timing diagram of the MLA method of the present invention. The frame start signal 302 is first generated in sync with the system clock 301. The scan block signal 303 counts the address of display data RAM blocks. At the rising edge of the system clock display, the display data of each block are outputted as a display data signal 304 and, at the same time, the signal for the mismatch numbers 306 are generated based on the display data signal 304 and row orthogonal signals 305.

Figure 9:
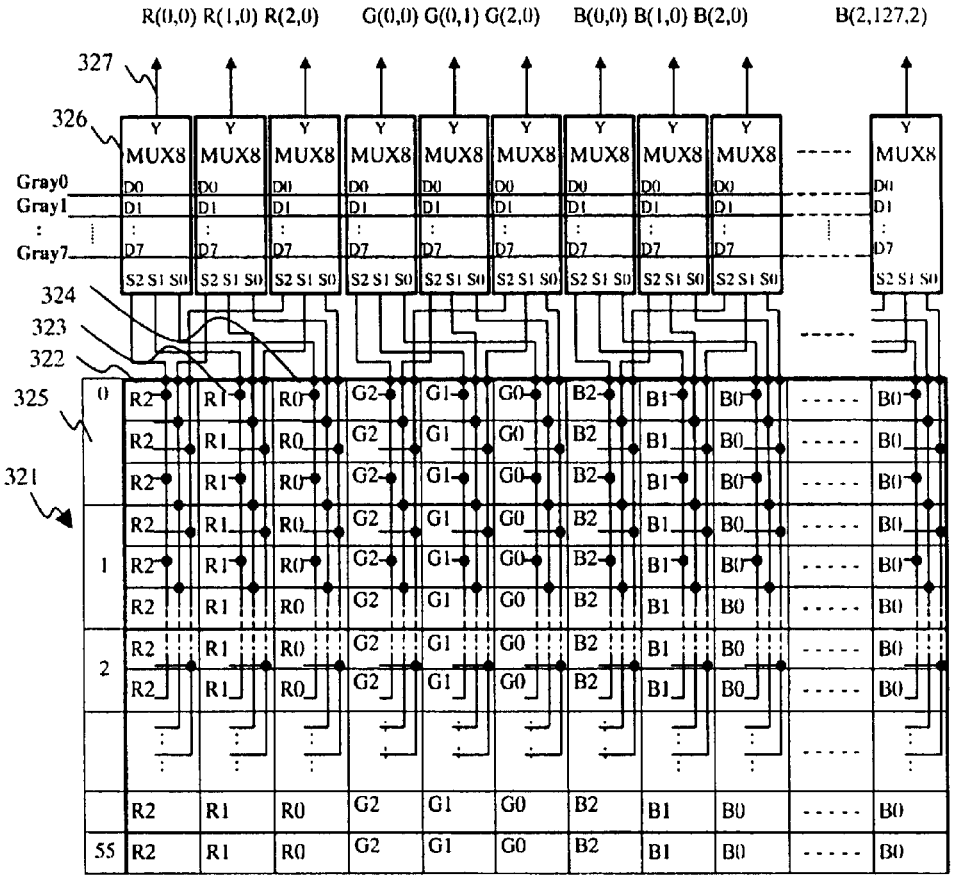
FIG. 9 is an illustration of a structure of a display data RAM for color display in accordance with the present invention.

FIG. 9 shows a block diagram of another display data RAM for use with a color display in accordance with the present invention. The example shows a RAM 321 consisting of 56 rows by 128×3 columns of addressable bits for storing RGB pixel data. Each primary color of RGB is represented by 3 bits making 8 different shades available for each primary color, and thus 512 different colors in combinations. Each bit is stored in a memory cell such as 322.

When a scan block, such as scan block 325, is activated, three bits for Red in the first row, such as 322, 323 and 324, are combined to select a gray level Red by making use of a multiplexer, such as 326, which selects one gray level as an output, such as R(0,0) 327 out of 8 predetermined gray levels, Gray0 through Gray 7. Three bits for Red in the second row within the activated scan block 325 are combined by a multiplexer to produce a gray-level output R(1,0). Similarly, three bits for Red in the third row within the activated scan block are combined by a multiplexer to produce a gray-level output R(2,0). Each three gray level colors in the adjacent rows along the same column, such as R(0,0), R(1,0), and R(2,0), are then combined with the orthogonal functions to calculate the mismatch numbers.

While the invention has been described with reference to preferred embodiments, it is not intended to be limited to those embodiments. It will be appreciated by those of ordinary skilled in the art that many modifications can be made to the structure and form of the described embodiments without departing from the spirit and scope of this invention.

What is claimed is:

1. A driver for driving an LCD (liquid crystal display) panel associated with i number of scan lines and j number of column lines, said i and j being positive integers not less than 2, the driver comprising:

a display data memory for storing display data, the display data memory arranged in a matrix corresponding to the i number of the scan lines and the j number of the column lines and concurrently outputting the display data corresponding to a scan block corresponding to m number of the scan lines and said j number of the column lines, said m being a positive integer not less than 2 and not more than i; and a column signal circuit for generating column display signals by modifying the concurrently output display data, the column display signals generating a display on the LCD panel in accordance with the concurrently output display data, wherein said column signal circuit comprises:

an XOR (exclusive OR) block including j number of XOR sets for performing exclusive OR operations between the concurrently output display data and orthogonal function data to determine mismatches, each XOR set including m number of XOR gates corresponding to the m number of the scan lines in each scan block.

2. The driver of claim 1, wherein said column signal circuit further comprises:

a decoder block including j number of decoders, the decoders for decoding results of the exclusive OR operations to determine mismatch numbers.

3. The driver of claim 2, wherein said column signal circuit further comprises:

a level-shifter block including j number of level shifters, the level shifters for shifting the data levels of the mismatch numbers to different data levels.

4. The driver of claim 3, wherein said column signal circuit further comprises:

a voltage selector block including j number of voltage selectors, the voltage selectors for selecting voltage levels corresponding to the mismatch numbers.

5. The driver of claim 4, wherein m is 3.

6. The driver of claim 5, wherein each of said level shifters is a 1-bit level shifter.

7. The driver of claim 6, wherein each of said voltage selectors selects one voltage level from 2 voltage levels.

8. The driver of claim 3, wherein the level-shifter block is directly coupled to the decoder block to shift the data levels of the mismatch numbers to different data levels without storing the mismatch numbers in output latches.

9. The driver of claim 1, wherein the XOR black is directly coupled to the display data memory to perform the exclusive OR operations on said concurrently output display data without storing said concurrently output display data in data latches prior to the exclusive OR operations.

10. A liquid crystal display, comprising:

a LCD (liquid crystal display panel associated with i number of scan lines and j number of column lines said i and j being positive integers not less than 2;

a row driver for selecting the scan lines;

a column driver for driving the column lines;

a display data memory for storing display data, the display data memory arranged in a matrix corresponding to the i number of the scan lines and the j number of the column lines and concurrently outputting the display data corresponding to a scan block corresponding to m number of the scan lines and said i number of the column lines, said m being a positive integer not less than 2 and not more than i; and a column signal circuit for generating column display signals by modifying the concurrently output display data, the column display signals generating a display on the LCD panel in accordance with the concurrently output display data, wherein the column signal circuit comprises:

an XOR (exclusive OR) block including j number of XOR sets for performing exclusive OR operations between the concurrently output display data and orthogonal function data to determine mismatches, each XOR set including m number of XOR gates corresponding to the m number of the scan lines in each scan block;

a decoder block including j number of decoders, the decoders for decoding results of the exclusive OR operations to determine mismatch numbers;

a level-shifter block including j number of level shifters, the level shifters for shifting the data levels of the mismatch numbers to different data levels; and a voltage selector block including j number of voltage selectors, the voltage selectors for selecting voltage levels corresponding to the mismatch numbers.

11. The liquid crystal display of claim 10, wherein the XOR block is directly coupled to the display data memory to perform the exclusive OR operations on said concurrently output display data without storing said concurrently output display data in data latches prior to the exclusive OR operations.

12. The liquid crystal display of claim 10, wherein the level-shifter block is directly coupled to the decoder block to shift the data levels of the mismatch numbers to different data levels without storing the mismatch numbers in output latches.

13. A method for driving an LCD (liquid crystal display) panel associated with i number of scan lines and j number of column lines, said i and j being positive integers not less than 2, the method comprising the steps of:

concurrently retrieving display data from a scan block of a display data memory, the display data memory arranged in a matrix corresponding to the i number of the scan lines and the j number of the column lines and the scan block corresponding to m number of the scan lines and said j number of the column lines, said m being a positive integer not less than 2 and not more than i; and generating column display signals by modifying the concurrently retrieved display data, the column display signals generating a display on the LCD panel in accordance with the concurrently retrieved display data, wherein modifying the concurrently retrieved display data comprises applying orthogonal function data to the concurrently retrieved display data by performing, exclusive OR operations between said concurrently retrieved display data and said orthogonal function data to determine mismatches, wherein the exclusive OR operations are performed on said concurrently retrieved display data without storing said concurrently retrieved display data in data latches prior to the exclusive OR operations.

14. A method for driving an LCD (liquid crystal display) panel associated with i number of scan lines and j number of column lines, said i and j being positive integers not less than 2, the method comprising the steps of:

concurrently retrieving display data from a scan block of a display data memory, the display data memory arranged in a matrix corresponding to the i number of the scan lines and the j number of the column lines and the scan block corresponding to m number of the scan lines and said j number of the column lines, said m being a positive integer not less than 2 and not more than i; and generating column display signals by modifying the concurrently retrieved display data, the column display signals generating a display on the LCD panel in accordance with the concurrently retrieved display data, wherein generating column display signals comprises:

applying orthogonal function data to the concurrently retrieved display data by performing exclusive OR operations between said concurrently retrieved display data and said orthogonal function data;

decoding results of the exclusive OR operations to determine mismatch numbers; and shifting the data levels of the mismatch numbers to different data levels, wherein the data levels of the mismatch numbers are shifted without storing the mismatch numbers in output latches prior to the step of shifting the data levels of the mismatch numbers.

* * * * *

UNITED STATES PATENT AND TRADEMARK OFFICE

CERTIFICATE OF CORRECTION

PATENT NO. : 6,919,872 B2
DATED : July 19, 2005
INVENTOR(S) : Tae-Kwang Park and Keunmyung Lee It is certified that error appears in the above-identified patent and that said Letters Patent is hereby corrected as shown below:

Column 5,
Line 51, please replace “black” with -- block --.
Line 57, please insert a closing parenthesis -- ) -- after “display”.

Column 6,
Line 1, please replace “i” with -- j --.
Line 56, please remove the comma “,” after “performing”.

Signed and Sealed this

Twenty-fifth Day of October, 2005

JON W. DUDAS
*Director of the United States Patent and Trademark Office*